United States Patent [19]

Boisture

[11] Patent Number: 5,022,463

[45] Date of Patent: Jun. 11, 1991

[54] MULTI-HOSE FLEXIBLE LANCE TUBE CLEANING SYSTEM

[75] Inventor: Thomas B. Boisture, Baytown, Tex.

[73] Assignee: Ohmstede Mechanical Services, Inc., Baytown, Tex.

[21] Appl. No.: 607,524

[22] Filed: Nov. 1, 1990

Related U.S. Application Data

[63] Continuation-in-part of Ser. No. 490,776, Mar. 8, 1990.

[51] Int. Cl.[5] ..... F22B 9/08

[52] U.S. Cl. ..... 165/95; 15/317; 122/379; 122/391; 134/166 C; 134/167 C

[58] Field of Search ..... 122/379, 391, 392; 15/316 R, 316 A, 317; 165/95; 134/166 C, 167 C

[56] References Cited

U.S. PATENT DOCUMENTS

| | | | |
|---|---|---|---|
| 620,224 | 2/1899 | Bubser . | |
| 1,694,371 | 12/1928 | Burdick | 15/104.05 |
| 1,796,878 | 3/1931 | Watson | 134/24 |
| 2,494,380 | 10/1950 | Ellig | 134/168 |
| 2,604,358 | 7/1952 | Richards | 299/47 |
| 3,269,659 | 8/1966 | Shelton et al. | 239/187 |
| 3,589,388 | 6/1971 | Haneline, Jr. | 137/315 |
| 3,600,225 | 8/1971 | Parmelee | 134/24 |
| 3,794,051 | 2/1974 | Lee, Jr. et al. | 134/46 |
| 3,817,262 | 6/1974 | Caradeur et al. | 134/167 |
| 3,901,252 | 8/1975 | Riebe | 134/56 |
| 3,903,912 | 9/1975 | Ice, Jr. et al. | 134/167 |
| 3,938,535 | 2/1976 | Cradeur et al. | 134/167 |
| 4,095,305 | 6/1978 | Goodwin | 15/104.1 |
| 4,107,001 | 8/1978 | Kinzler | 202/241 |
| 4,199,837 | 4/1980 | Fisco, Jr. | 15/302 |
| 4,234,980 | 11/1980 | DiVito et al. | 15/302 |
| 4,322,868 | 4/1982 | Wurster | 15/302 |
| 4,422,210 | 12/1983 | Bergsand et al. | 15/302 |
| 4,503,811 | 3/1985 | Hammond | 122/392 |
| 4,543,711 | 10/1985 | Wada et al. | 29/726 |
| 4,547,963 | 10/1985 | Ohmstede | 29/726 |
| 4,669,145 | 6/1987 | Kear | 134/166 C X |
| 4,750,547 | 6/1988 | Sakamoto | 165/95 X |
| 4,805,653 | 2/1989 | Krajicek et al. | 134/166 C |
| 4,856,545 | 8/1989 | Krajicek et al. | 134/166 |

OTHER PUBLICATIONS

Single and Multi Rotating Lance Bundle Cleaner Drawings: Hydrovac Industrial and Petroleum Services, Ltd., 1/22/88, 2/2/88, 4/2/88.

Dow Sales Brochure for Jet-Cleaning Heat Exchanger Tubes with Mini-Lancer Service.

Weatherford Water Jetting Systems, Heat Exchanger Tube Lancing Machine, Jun. 1988.

Hydrovac International, Ltd., Sales Brochure, date unknown.

Browning Ferris Industries Chemical Services, Inc., no date, pp. RC 1007-1009, date unknown.

May 1971 Cesco, Inc. Annual Report, pp. 8-9.

Cesco Scene, Cesco, Inc., Company Newsletter, date unknown.

Cesco Scene, Cesco, Inc., Company Newsletter, pp. RC-1058, date unknown.

R. Lee, R. Torbin, R. Bello, "State of the Art Mechanical Cleaning of Heat Exchangers," Oct. 1985, American Society of Mechanical Engineers, pp. 7-8.

J. Twigg, "High-Pressure Water Jetting Techniques", Corrosion Prevention and Control, Apr. 1982.

*Primary Examiner*—Edward G. Favors

*Attorney, Agent, or Firm*—Pravel, Gambrell, Hewitt, Kimball & Krieger

[57] ABSTRACT

A multi-hose flexible lance tube cleaning apparatus for cleaning the interior of heat exchanger tubes, the apparatus having a spool and means for rotating the spool. A plurality of tubular flexible lances are reeled on the spool assembly. Each flexible lance is in communication with a high pressure fluid source and is adapted to fit within a heat exchanger tube. The flexible lances advance into the interior of the heat exchanger tubes as the spool is rotated to reel out the flexible lances and as the high pressure fluid exits the jetting tips of the flexible lances. The cleaning apparatus also includes tube guides to guide and support the flexible lances and further includes a positioning assembly for positioning the flexible lances in substantial alignment with the heat exchanger tubes.

11 Claims, 4 Drawing Sheets

MULTI-HOSE FLEXIBLE LANCE TUBE CLEANING SYSTEM

This Application is a continuation-in-part of U.S. application Ser. No. 490,776, filed Mar. 8, 1990 for a MULTI-LANCE TUBE CLEANING SYSTEM. The inventor listed in the present application was a named inventor in application Ser. No. 490,776.

BACKGROUND OF THE INVENTION

1. Field of the Invention

The present invention relates to an apparatus for cleaning the interior of tubes in a heat exchanger tube bundle. More particularly, the present invention relates to an apparatus for simultaneously cleaning the interior of several tubes within a heat exchanger tube bundle without removing the tube bundle from the heat exchanger.

2. Description of Prior Art

Heat exchanger tube bundles are used for the transfer of heat from a fluid media passing through a series of conduits. During this process, carbonaceous and calcareous deposits will form on the interior of the individual tubes and debris and other dirt will collect on the surface of the individual tubes. Therefore, in order to maintain efficient operation, it is necessary to periodically clean the interior and exterior of the tubes.

One method of cleaning the interior of heat exchanger tubes includes the progressive insertion of a small diameter tube, known as a lance, into the heat exchanger tube and pumping high pressure water through the lance to clean the interior of the tube. The water pressure in the lance may easily exceed 10,000 psi and flow rates in excess of 100 gallons per minute. Early prior art devices called for the lance to be manually operated and advanced into the heat exchanger tube. It will be appreciated that the manual operation of a lance is unsatisfactory for a number of reasons. First, the operator is required to overcome the force of the water pressure when inserting the lance into the tube. Further, should the lance wall rupture, an operator may be injured by the high pressure water flow. Similarly, an operator may be injured by backsplash from the lance during the insertion of the lance into the tube. Lastly, the manual operation of a lance is time consuming and costly, as only one lance may be used in manual operations.

Various mechanical devices have been used in an effort to overcome the above deficiencies in cleaning the interior of heat exchanger tubes. U.S. Pat. No. 3,903,912 to Ice, Jr. et al. discloses a multiple lance cleaning system, including lance positioning and drive means and exposed lance tubes. However, the use of exposed lance tubes continues to pose a danger to an operator should a lance wall rupture. U.S. Pat. No. 3,817,262 to Caradeur et al. also discloses a multiple lance cleaning system having a lance positioner and drive system and exposed lance tubes. However, as in the Ice disclosure, the operator is still exposed to the danger of potential lance tube rupture.

U.S. Pat. No. 3,901,252 to Riebe discloses a multiple lance system including a lance drive and enclosed lance tubes, manifold and water lines. However, Riebe does not disclose a lance positioning system capable of readily positioning the lances and lance drive into a multitude of tubes within the heat exchanger bundle. U.S. Pat. No. 4,856,545 to Krajicek et al. disclosed a multi-lance tube cleaning system having a lance drive means, lance tubes and manifold, and multiple high pressure water lines within an enclosed structure. The disclosure called for the cleaning structure to be positioned by a crane mounted on a truck or by other mobile crane, tractor or skid. However, there are a number of disadvantages, i.e., as the lances are moved forward, the center of gravity of the structure may shift, which could result in misalignment and unnecessary stress on the lance tubes.

A significant disadvantage of the above described multi-lance tube bundle cleaners is the amount of space required by the tube bundle cleaning apparatus. The tube bundle cleaners disclosed have a framework extending at least the length of the tube lances which is positioned adjacent to the tube bundle. Typically, a very limited amount of space surrounds the heat exchanger, making it difficult either to remove the tube bundle for cleaning or to clean the tubes with a prior art tube bundle cleaning apparatus while the tube bundle is in the heat exchanger. Additionally, some tube bundles are vertically positioned in the heat exchanger making it very difficult to clean the tubes with a tube bundle cleaning apparatus, as disclosed in the above patents, while the tube bundle is in place.

Accordingly, there exists a need for an improved tube bundle cleaner which is sufficiently portable to allow tubes to be cleaned while in place in the heat exchanger, regardless of whether the tubes are in a horizontal or vertical position. Furthermore, there exists a need for a portable tube bundle cleaner which cleans multiple tubes, has a lance drive means, enclosed lances, and an independent means for positioning the lance cleaning system.

SUMMARY OF THE INVENTION

The present invention relates to a multi-hose flexible lance apparatus for cleaning the interior of tubes within a heat exchanger tube bundle without the necessity of removing the tube bundle from the heat exchanger. The multi-hose flexible lance apparatus has a plurality of flexible lances wrapped around a motor-driven spool. Each flexible lance has a jetting tip attached at the forward end of the flexible lance. As the spool rotates, the flexible lances pass through a guiding arrangement and enter the tubes for cleaning. High pressure liquid travels through the flexible lance and exits through the jetting tips. The exiting high pressure liquid through the jetting tips cause each flexible lance to be in tension and to advance into the interior of the tubes as the rotating spool reels out the flexible lance. The portable multi-hose flexible lance apparatus includes a positioner assembly which mounts on a tube bundle flange and which permits proper positioning and supporting of the cleaning apparatus with respect to the tubes to be cleaned. The apparatus can clean tubes in the horizontal or vertical position and from the top or bottom of a vertical tube.

BRIEF DESCRIPTION OF THE DRAWINGS

A better understanding of the invention can be had when the following detailed description of the preferred embodiment is considered in conjunction with the following drawings, in which.

DETAILED DESCRIPTION OF THE INVENTION

Figure 1:
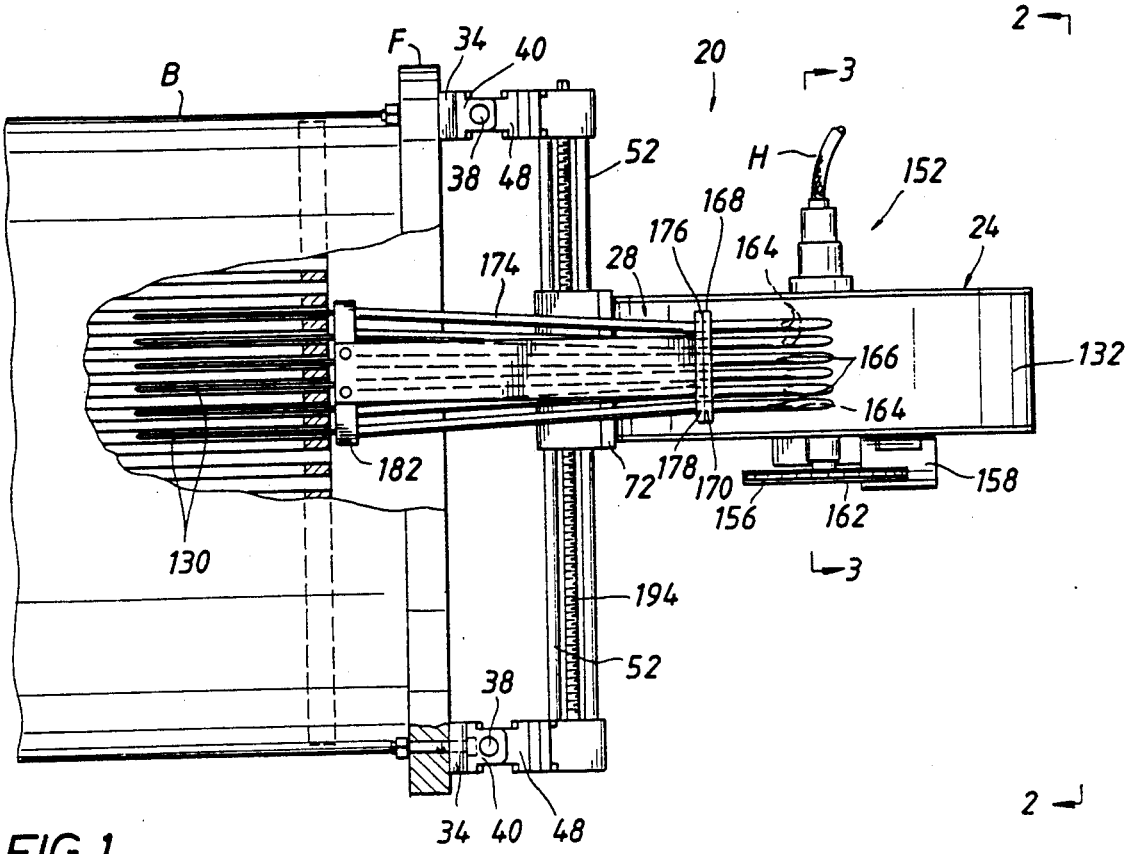
FIG. 1 is an elevation view of the preferred embodiment.
Figure 2:
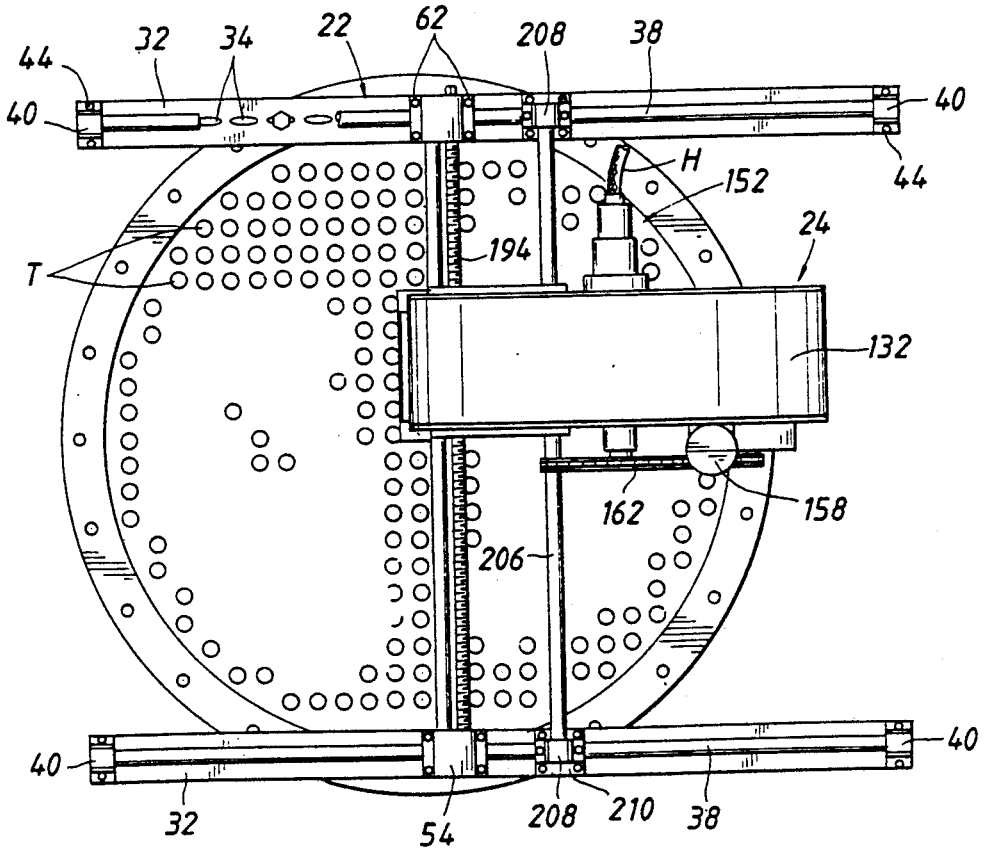
FIG. 2 is a view taken along line 2—2 of FIG. 1.

FIGS. 1 and 2 are side and top views of the preferred embodiment of the invention. A heat exchanger tube bundle "B" is shown in a horizontal position. It should also be understood that the heat exchanger tube bundle "B" may be positioned in a vertical position without affecting the effectiveness of the present invention. The tube bundle "B" includes an array of tubes "T." Depending on the size of the heat exchanger tube bundle "B," there may be several hundred tubes "T" in the tube bundle "B." Typically, the individual tubes "T" have an outside diameter of 0.75 inches and are spaced 1.00 inches apart, center to center. In FIGS. 1 and 2, the heat exchanger tube bundle "B" has had a flanged end cap (not shown) removed to expose open ends of the individual tubes "T" for cleaning purposes. A tube bundle flange "F" mates with the flanged end cap (not shown).

The multi-hose flexible lance apparatus 20 of the present invention is comprised primarily of a positioner assembly 22, a spool assembly 24, flexible lance assemblies 26, and a lance indexing assembly 28.

Figure 7:
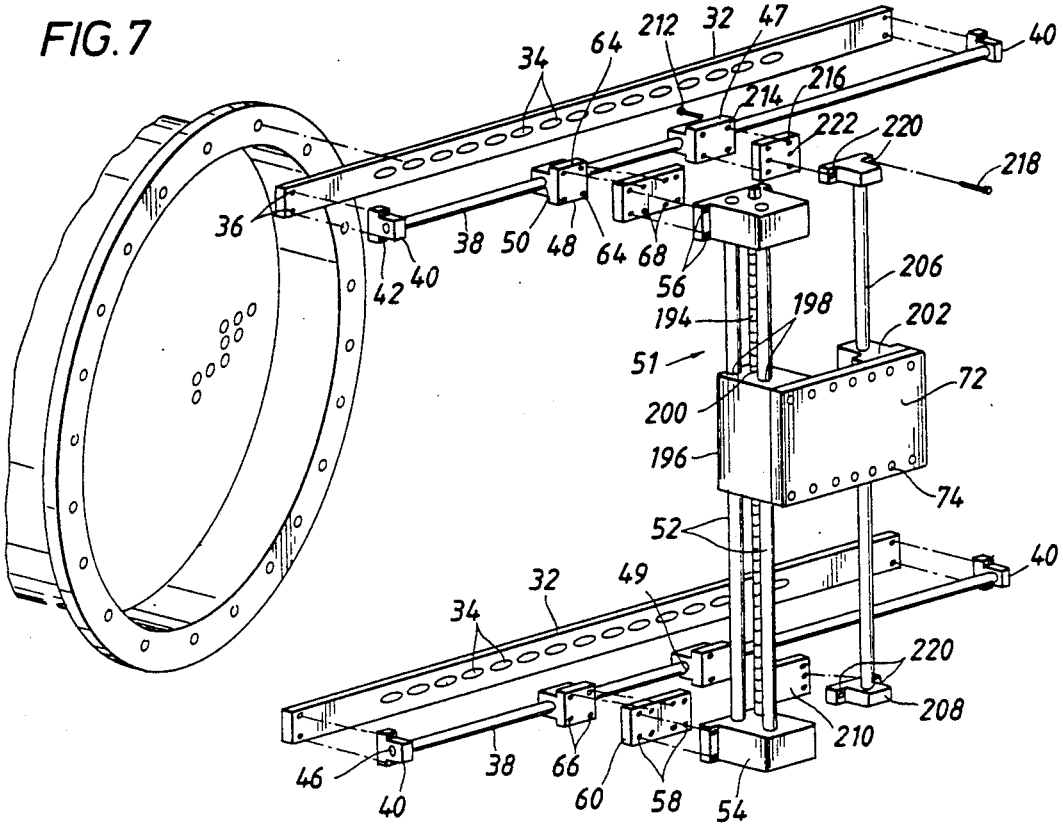
FIG. 7 is an exploded view of the positioning assembly of the preferred embodiment.

Referring to FIGS. 1, 2 and 7, the positioner assembly 22 is comprised of a pair of mounting brackets 32 having a plurality of apertures 34 extending through each mounting bracket 32. The mounting bracket 32 is a flat bar which further includes a pair of holes 36 at each end of the mounting bracket 32. A lateral carrier rod 38 is mounted to each mounting bracket 32 by lateral carrier rod supports 40 at each end of the lateral carrier rod 38. Each lateral carrier rod support 40 includes a pair of holes 42 sized and spaced to correspond to the pair of holes 36 in the mounting bracket 32. Fasteners 44 (FIG. 2), such as threaded bolts and nuts, secure the lateral carrier rod support 40 to the mounting bracket 32. As shown in FIG. 7, the lateral carrier rod supports 40 have an aperture 46 for receiving and securing the lateral carrier rod 38 between the lateral carrier rod supports 40. A carriage traveling clamp 48 and a secondary traveling clamp 47 are mounted on each lateral carrier rod 38 and are permitted to travel along the lateral carrier rod 38 between the lateral carrier rod supports 40. The carriage traveling clamp 48 and the secondary traveling clamp 47 have a longitudinal opening 50 and 49 respectively which receives the lateral carrier rod 38 and allows the traveling clamps 47, 48 to slide on the lateral carrier rod 38.

A transverse carrier rod assembly 51 includes a transverse carrier rod support 54 attached to each end of a pair of transverse carrier rods 52. The transverse carrier rod supports 54 are mounted to the traveling clamps 48. Each transverse carrier rod support 54 includes two pairs of holes 56 corresponding to two pairs of holes 58 in a support plate 60. Two pairs of fasteners 62, typically bolts and nuts, inserted through the transverse carrier rod support holes 56 and the support plate holes 58 firmly secure the transverse carrier rod support 54 to the support plate 60. Each carriage traveling clamp 48 includes a pair of flanges 64 having a pair of clamp holes 66 on each of the flanges 64. The support plate 60 further includes holes 68 which correspond to the clamp holes 66 in the traveling clamps 48. Suitable fasteners (not shown) extend through the clamp holes 66 and the corresponding holes 68 in the support plate 60 for securing the support plate 60 to the traveling clamps 48.

The transverse carrier rod assembly 51 also includes a threaded shaft 194 rotatably supported at both ends by the transverse carrier rod supports 54. The thread on shaft 194 may be an acme or other suitable thrust bearing thread. A threaded carriage assembly 196 has a pair of smooth bores 198 through which the transverse carrier rods 52 are inserted and an internally threaded bore 200 which mates with the threads on the shaft 194. The threaded shaft 194 is adapted to be manually rotated with a removable handle (not shown). As the threaded shaft 194 is rotated, the carriage assembly 196 travels along the length of the threaded shaft 194. Thus, the threaded carriage assembly 196 is allowed to travel along the length of the transverse carrier rods 52 between the transverse carrier rod supports 54 as the threaded shaft 194 is rotated. A spool assembly mounting plate 72 is affixed to the carriage assembly 196. The mounting plate 72 may be affixed to the carriage assembly 196 by threaded fasteners or by welding or by any suitable fastening means.

The spool assembly mounting plate 72 is also supported by a block 202 having a longitudinal bore 204 through which a secondary transverse carrier rod 206 is inserted. The secondary transverse carrier rod 206 is held at each end by a secondary transverse carrier rod support 208 which is adapted to be mounted on a secondary support plate 210. The secondary transverse carrier rod support 208 is mounted on the secondary support plate 210 by inserting fasteners 218 through holes 220 and 222 in the secondary transverse carrier rod support 208 and the secondary support plate 210 respectively. The secondary support plates 210 are adapted to be mounted on the secondary traveling clamps 47 with fasteners 212 being inserted through holes 214 and 216 of the secondary traveling clamp 47 and secondary support plate respectively.

Accordingly, it will be appreciated that the positioner assembly 22 allows the spool assembly 24 which is mounted on the spool assembly mounting plate 72 to travel in both the lateral and transverse directions with respect to the mounting brackets 32. The elongated apertures 34 in the mounting brackets 32 enables the positioner assembly 22 to be mounted to suitable holes in the flange "F" of the tube bundle "B," irrespective of the exact size flange "F" and the spacing of the holes in the flange "F."

The spool assembly 24 provides storage of the flexible lance assembly 26. The spool assembly 24 comprises a spool housing 80 which is removably fixed to the spool assembly mounting plate 72. Rotatably mounted in spool housing 80 is a spool 84. The spool 84 comprises a spindle 86, a shaft 88, an inner circumference plate 90, side plates 92 and section plates 94. Spool spindle B6 further includes a blind hole 96 therein along the longitudinal axis of spindle 86. A plurality of radial passageways 98 in spindle 86 are in fluid communication with the blind hole 96. Each of the radial passageways 98 are adapted to be removably connected to a water tubing nipple 100 which is itself connected to a tubing elbow 102. Each radial passageway 98 includes internal threads 104 adapted to sealingly mate with external threads 106 on a spindle fitting 108. The tubing nipple 100 has a pair of externally threaded fittings 110 inserted on the tubing nipple 100. The ends of the tubing nipple 100 are then flared. The spindle fitting 108 and the tubing elbow 102 each have internal threads 112 and 114, respectively, for sealingly engaging the externally threaded fittings 110 on the flared ends of the tubing nipple 100. The tubing elbow 102 contains an orifice 116 entering the tubing elbow 102 at the tubing nipple 100 face and exiting at a face generally perpendicular thereto. The exit of the orifice 116 has internal threads 118 for receiving an adapter 120. The adapter 120 has a continuous orifice 122 passing therethrough. The adapter 120 has a male, externally threaded end 124 which threadably engages with the internal threads 118 of the tubing elbow 102. The other end of the adapter 120 has an internally threaded female end 126 which receives a threaded male end 128 of a high pressure water hose flexible lance 130 of the flexible lance assembly 26.

The flexible lance assembly 26 includes the high pressure water hose flexible lance 130 and a jetting tip 188. The water hose flexible lance 130 is a semirigid high pressure water hose capable of withstanding pressures in excess of 30,000 pounds per square inch (psi). A typical water pressure hose flexible lance 130 would be Model 2004 StR or equivalent manufactured by Rogan-Shanley, Inc. of Houston, Tex.

Figure 5:
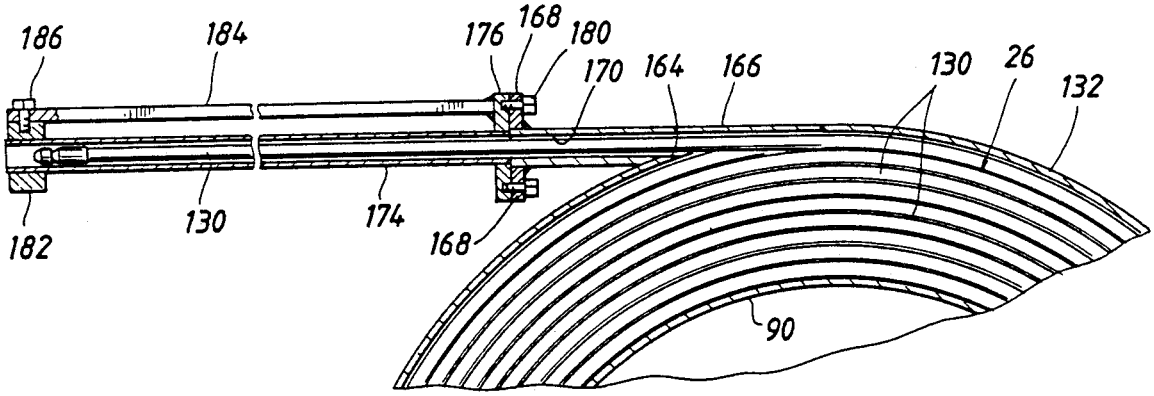
FIG. 5 is a cross-sectional view taken along line 5—5 of FIG. 3 showing the spool portion and transition section of the preferred embodiment.
Figure 6:
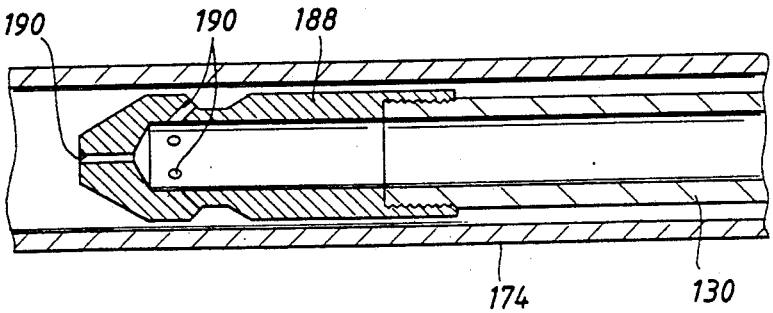
FIG. 6 is a cross-sectional view of the jetting tip of the preferred embodiment.

As previously discussed, one end of the flexible lance 130 has a threaded male end 128 which threadably engages the adapter 120. The other end of the flexible lance 130 has a jetting tip 188 as shown in FIGS. 5 and 6. The jetting tip 188 has a plurality of nozzles 190 through which high pressure water exits the jetting tip 188 of the flexible lance assembly 26. As shown in FIG. 6, the nozzles 190 primarily direct the exiting water jets in an outward and rearward direction during the cleaning operation of the tubes "T" which has a net effect on the flexible lance assembly 26 of maintaining the flexible lance assembly 26 in tension. Thus, during the cleaning operation, the flexible lance assemblies 26 have a resultant axial tensile force due to the pressurized water exiting the jetting tip 188 which causes each flexible lance assembly 26 to advance into the tubes "T" as the spool 84 rotates in a direction to reel out the flexible lances 130. Similarly, the resultant axial tensile force provides resistance when reversing the rotation of the spool 84 to reel in the flexible lances 130 on the spool 84. Thus, the flexible lances 100 wrap neatly and tautly on the spool 84.

Figure 3:
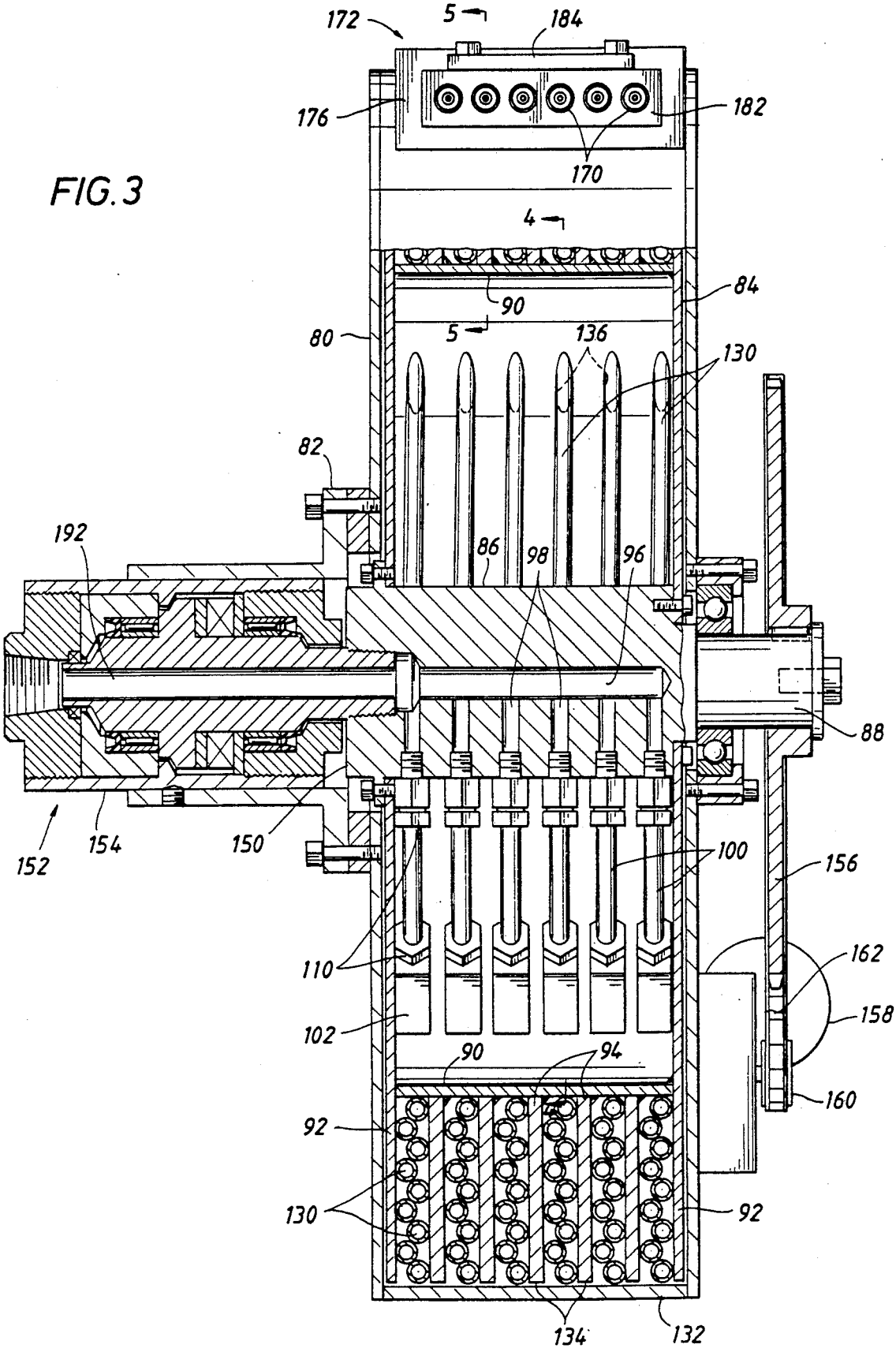
FIG. 3 is a cross-sectional view taken along line 3—3 of FIG. 1 showing the spool portion of the preferred embodiment.

As may be seen in FIG. 3, a plurality of water hose flexible lances 130 are reeled onto the inner circumference plate 90 of the spool 84. Each flexible lance 130 is maintained separate and apart from the other flexible lances 130 by the section plates 94. A single flexible lance 130 is maintained between two adjacent section plates 94 or between a side plate 92 and the adjacent section plate 94. Each flexible lance 130 has several wraps on the spool 84. For example, in FIG. 3, each flexible lance 130 has nine wraps around the spool 84. The number of wraps of the flexible lance 130 on the spool 84 is dependent on the length of the flexible lance 130 and the diameter of the inner circumference plate 90. The length of each flexible lance is the same and is required to be slightly greater in length than the tubes "T" to be cleaned to allow for the length of the flexible lance 100 from the spool connection to the open end of the tube "T" to be cleaned.

An outer circumference plate 132 is connected to the spool housing 80. The outer circumference plate 132 encloses the spool 84 and the flexible lances 130 to protect an operator from possible injury caused by a ruptured flexible lance 130. The outer circumference plate 132 is positioned just beyond an outer edge 134 of the side plates 92 and the seCtion plates 94 tO further ensure that each flexible lance 130 remains in the appropriate space between the adjacent section plates 94 or the side plate 92 and the adjacent section plate 94.

Figure 4:
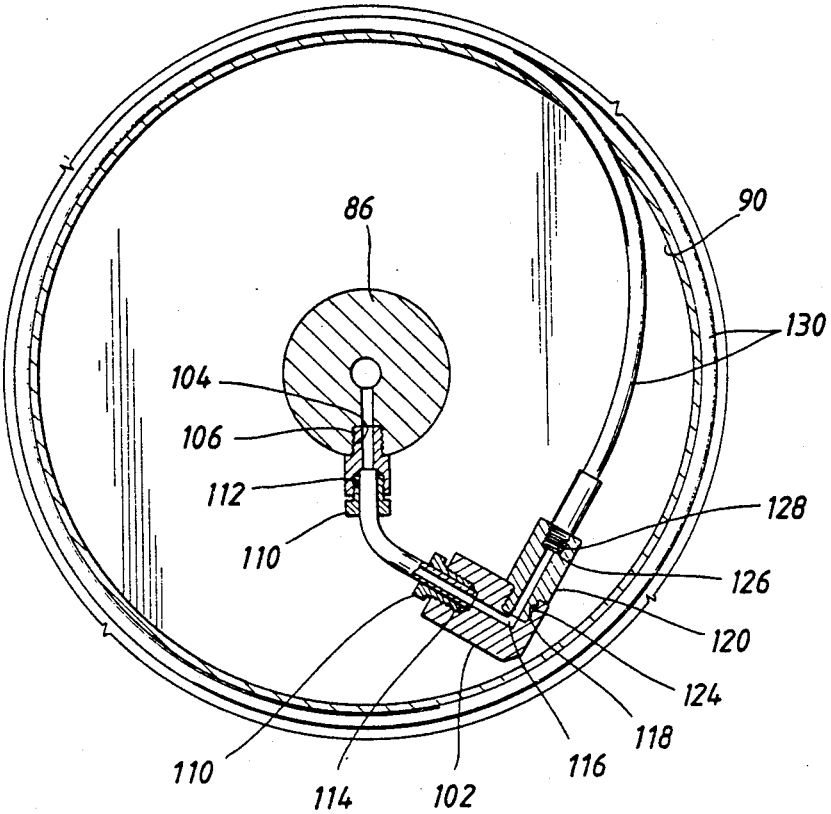
FIG. 4 is a cross-sectional view taken along line 4—4 of FIG. 3 showing the flexible lance connection to the spool portion of the preferred embodiment.

The radius of the inner circumference plate 90 is limited by the minimum bending radius for the flexible lance 130. As shown in FIGS. 3 and 4, the inner circumference plate 90 includes a plurality of elongated openings 136 which allow the flexible lances 130 to be connected to the internal spindle 86 of the spool 84 and then be wrapped around an outer surface 91 of the inner circumference plate 90.

Referring to FIG. 3, affixed to a first end 150 of the spool spindle 86 is a rotating swivel 152. The rotating swivel 152 has a stationary external housing 154 which is removably connected to the spool assembly housing 80 at one end and is adapted to be connected to a high pressure water source through hose "H" at the other end. The rotating swivel 152 also includes a rotating spindle 153 which is coaxially affixed to the spool spindle 86. The rotating spindle 153 has a longitudinal bore 192 which coaxially extends from the blind hole 96 of the spindle 86. The longitudinal bore 192 extends entirely through the swivel 152. A typical rotating swivel 152 would be Model HF Swivel or equivalent manufactured by Stone Age Company of Durango, Colo.

Referring to FIG. 3, coaxially affixed to spindle 86 is the spool shaft 88. Mounted on the spool shaft 88 is a drive sprocket 156. Mounted external to spool housing 80 is a hydraulic motor 158 having a drive sprocket 160. The motor drive sprocket 160 and spool drive sprocket 156 are in rotational communication by means of a drive chain 162. It is understood that the embodiment includes the use of drive pulleys and a drive belt to accomplish the transfer of rotational movement from motor 158 to spool 84. Further, motor 158 may be mounted external to spool housing 80 in a manner such that a motor drive gear would be in direct rotating contact with a drive gear mounted on spool shaft 88.

Referring to FIGS. 1, 3 and 5, the outer circumference plate 132 of the spool housing 80 includes a plurality of openings 164 which are the same in number as the flexible lances 130. Each opening 164 is appropriately sized and shaped to allow the flexible lances 130 to travel therethrough. A guide tube 166 is preferably welded to the outer circumference plate 132 at each of the openings 164 in the outer circumference plate 132. The guide tubes 166 have a sufficiently large internal diameter to permit the flexible lances 130 to pass through. The opposite ends of the guide tubes 166 engage a guide tube flange 168. The guide tube flange 168 includes a plurality of holes 170 (FIG. 1) passing therethrough. Each guide tube 166 sealingly engages the guide tube flange 168 about a hole 170 in the guide tube flange 168.

The present invention is adapted to clean various heat exchanger tube bundles "B." It will be appreciated that the size of a heat exchanger tube "T" and the manner in which the tubes are spaced within a tube bundle "B" affect the required spacing between the tubes. Consequently, in order for the present invention to efficiently clean the interior of a heat exchanger tube bundle "B," it is necessary that the present invention be capable of adjustment for various tube sizes and spacing. Accordingly, it is necessary to align the flexible lances 130 with the tube alignment. In order to accomplish this objective, the present invention includes an indexing assembly 28 which is adapted to compensate for variations in tube size and spacing.

Figure 8:
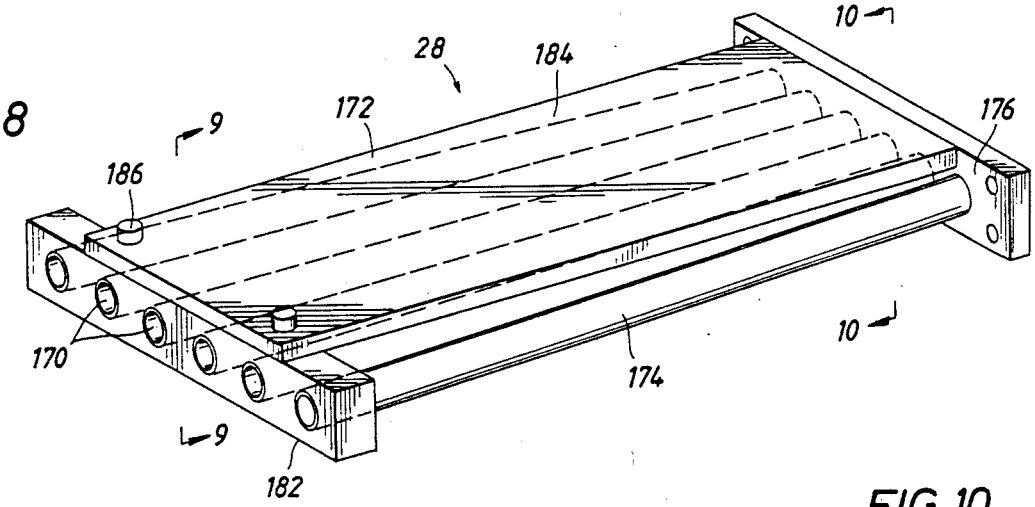
FIG. 8 is a perspective view of the transition section of the preferred embodiment.
Figure 9:
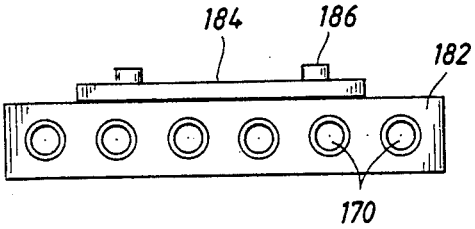
FIG. 9 is an end view taken along line 9—9 of FIG. 8 showing the forward indexing head of the preferred embodiment.
Figure 10:
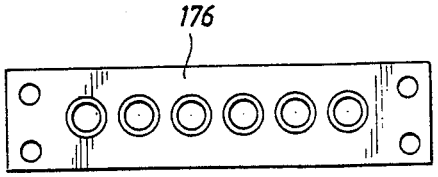
FIG. 10 is an end view taken along line 10—10 of FIG. 8 showing the transition flange of the preferred embodiment.

The removably connected indexing assembly 28 includes a transition section 172 having a plurality of index guide tubes 174 which are attached at one end to a transition flange 176 and at the other end to a forward indexing head 182. The transition flange 176 has a plurality of openings 178 (FIG. 1) corresponding to the openings 170 in the guide tube flange 168. The transition flange 176 is removably connected to the guide tube flange 168 by a plurality of fasteners 180. The index guide tubes 174 have a sufficiently large internal diameter to permit flexible lances 130 to pass through. The index guide tubes 174 are bent to alter the spacing between adjacent index guide tubes 174 to match that of the tubes "T" within the tube bundle "B." The forward indexing head 182 which is adapted to reflect the spacing of the tubes "T" for the particular tube bundle "B" being cleaned is fitted between the index guide tubes 174. In FIG. 9, the forward indexing head 182 is shown as having a given spacing. Additional forward indexing heads 182 are provided to accommodate tube bundles "B" having tubes "T" at different spacings. As shown in FIG. 8, the forward indexing head 182 is fastened to a transition bar 184 which is further attached to the transition flange 176. The transition bar 184 is connected, preferably by welding, to the transition flange 176. The opposite end of the transition bar 184 has two holes (not shown) which permit bolts 186 to removably connect the forward indexing head 182 to the transition bar 184. The forward indexing head 182 includes internal threaded holes (not shown) which receive the threaded bolts 186.

OPERATION OF THE PRESENT INVENTION

Due to the weight and size of heat exchanger tube bundles, it is necessary to clean the tube bundles on site. Accordingly, it is necessary to transport the present invention to a job site for operations. The present invention is compact and may be used in conjunction with any high pressure, high volume fluid source, although it is contemplated that the present invention will be used in conjunction with the invention disclosed and claimed in U.S. patent application No. 489,001.

The positioner assembly 22 is bolt connected to the flange "F" of the tube bundle "B" to be cleaned. If the tubes "T" in the tube bundle "B" are horizontally positioned, the mounting brackets 32 will be attached to the flange "F" in a plane parallel to a generally horizontal row of tubes "T." The mounting brackets 32 should be parallel to the horizontal row of tubes "T" so that the vertical alignment of the flexible lances 130 with the horizontal row of tubes "T" is maintained without adjusting the elevation of the carriage assembly 196. Furthermore, a generally horizontal mounting of the mounting brackets 32 minimizes the force required to slide the spool assembly 24 mounted on the transverse carrier rods along the lateral carrier rods 38. Also, horizontal placement of the mounting brackets 32 on the flange "F" vertically orients the transverse carrier rods 52 and the threaded shaft 194. The threaded shaft 194 resists the gravitational force acting on the spool assembly 24 and restrains the spool assembly 24 from downward movement resulting from gravity. Thus, horizontal positioning of the flexible lances 130 is accomplished by manually sliding the spool assembly 24 on the lateral carrier rods 38. Vertical positioning of the flexible lances 130 is accomplished by rotating the threaded shaft 194. When cleaning vertically positioned tubes "T," the only requirement is that the mounting brackets 32 be mounted parallel to a row of tubes "T" so that the row of flexible lances corresponds to a row of tubes "T."

A control pendant (not shown) controls a high pressure water source and hydraulic fluid flow used to power the present invention. While the control pendant may be configured to control any suitable high pressure water source and hydraulic flow, it is contemplated that the present invention, including the control pendant, has been specifically configured to operate with the high pressure water source and hydraulic pressure source described in U.S. patent application No. 489,001. The remote control pendant (not shown) permits the operator to direct and observe lancing operations while maintaining a safe distance from the high pressure flexible lances 130.

The spool assembly 24 is then secured to the mounting plate 72 of the carriage assembly 196. It is contemplated that the spool assembly 24 may be positioned on the mounting plate 72 along any of the four sides of the mounting plate 72. This permits maximum versatility to allow the row of flexible lances 130 to be horizontally positioned or vertically positioned on the top/bottom or left/right sides of the mounting plate 72, respectively.

The operator inspects the tube "T" spacing and selects the forward indexing head 182 which best corresponds with the tube size and spacing. The independent tubes 174 are inserted in the forward indexing head 182 and the forward indexing head is connected to the transition bar 184. The lance indexing assembly 2 is mounted to the guide tube flange 168 so that the forward indexing head 182 is positioned very near the open ends of the tubes "T." Due to variations in the distance from the open end of the tubes "T" to the tube bundle flange "F," it may be necessary to insert spacers (not shown) between the spool assembly 24 and the mounting plate 72. Alternatively, spacers could be inserted between the lance indexing assembly 28 and the guide tube flange 168.

A flexible hydraulic hose (not shown) interconnects the hydraulic drive motor 158 with a suitable hydraulic pressure source. The flexible lances 130 are in fluid communication with a high pressure water source (not shown) by means of a high pressure hose "H" which connects to the rotating swivel 152. The flexible lances 130 are then manually positioned with respect to the tube bundle tubes "T" by rotating the threaded shaft 194 and manually sliding the spool assembly 72 and transverse carrier rods 52 along the lateral carrier rods 38 until the forward ends of the index guide tubes 174 are aligned with the tubes "T" to be cleaned. Hydraulic pressure to the hydraulic drive motor 158 rotates the drive sprocket 160, thus driving chain 162 to rotate the drive sprocket 156 and the spool 84. The high pressure water source is activated by the operator causing the high pressure water to flow through hose H, swivel 152, spindle blind passageway 96, radial passageways 98, tubing nipples 100, tubing elbows 102, through the flexible lances 130 and out through the jetting tip 188. The tension in the flexible lances 130 advances the flexible lances 130 through the index guide tubes 174 and into the individual tubes "T." The flexible lances 130 continue to advance into the tubes, cleaning deposits away from the inside. Should one of the flexible lances 130 encounter an obstruction it is unable to clean away, the excess water pressure will be channelled into the remaining flexible lances 130.

The present invention is capable of cleaning the interior of all tubes within a tube bundle which is either vertically or horizontally positioned. Further, the tube bundles are not required to be removed from the heat exchangers due to the compact size of the present invention. The compact size of the invention allows it to be used in areas having a very limited amount of working area. Additionally, the present invention can be handled without the use of cranes or other heaving lifting equipment.

The description given herein is intended to illustrate the preferred embodiment of the present invention. It is possible for one skilled in the art to make various changes to the details of the apparatus without departing from the spirit of this invention. Therefore, it is intended that all such variations be included within the scope of the present invention as claimed.

What is claimed is:

1. A multi-lance cleaning apparatus for cleaning the interior of heat exchanger tubes comprising:
- a spool;
- means for rotating said spool;
- a plurality of tubular flexible lances, each said flexible lance being adapted to fit within a heat exchanger tube, each said flexible lance wrapping on said spool and having a first end in communication with a fluid source and a second end adapted to enter a heat exchanger tube;
- means for supplying high pressure fluid to said flexible lances;
- means for supporting and positioning said spool substantially adjacent the open ends of the heat exchanger tubes;
- means for supporting and guiding said flexible lances in substantial alignment with the heat exchanger tubes to be cleaned; and
- means for advancing said flexible lances into and along the interior of the heat exchanger tubes.

2. The apparatus according to claim 1, further comprising:
- a spool housing for enclosing said spool and adapted to removably connect said spool to said means for supporting and positioning said spool assembly.

3. The apparatus according to claim 2, wherein said spool is rotatably mounted within said spool housing and further comprises:
- a spool spindle having a rotatable high pressure swivel mounted on one end and a drive shaft on the other end of said spindle.

4. The apparatus according to claim 3, wherein said means for supplying high pressure fluid to said flexible lances comprises:
- said spool spindle having a first end and a second end, said first end of said spindle having an opening forming a longitudinal passageway which terminates prior to reaching said second end of said spindle;
- said spool spindle further having a plurality of radial passageways which intersect said longitudinal passageway, said radial passageways are spaced along said longitudinal passageway, there being one said radial passageway corresponding to each said flexible lance;
- means for connecting each said flexible lance to a corresponding said radial passageway; and
- said rotatable high pressure swivel on said spool spindle having a longitudinal bore coaxially extending from said longitudinal passageway of said spindle, said rotatable high pressure swivel being in communication with the fluid source.

5. The apparatus according to claim 1, wherein said means for advancing said flexible lances into and along the interior of the heat exchanger tubes comprises:
- a plurality of jetting tips, one said jetting tip connected to said second end of each said flexible lance, each said jetting tip having a plurality of nozzles through which the high pressure fluid exits, the high pressure fluid exiting said jetting tip causes said flexible lance to be in tension and to advance said flexible lance along the interior of the heat exchanger tube as said spool is rotated to reel out said flexible lances.

6. The apparatus according to claim 5, wherein said jetting tips primarily direct the high pressure fluid in an outward and rearward direction to cause said flexible lances to be in tension and to advance said flexible lance along the interior of the heat exchanger tube as said spool assembly is rotated to reel out said flexible lances.

7. The apparatus according to claim 2, wherein said support and guide means comprises:
- a transition flange having a plurality of openings adapted to support said flexible lances, said transition flange being removably connected to said spool housing;
- a plurality of index guide tubes, said guide tubes being attached to said transition flange, said index tubes allow said flexible lances to pass therethrough; and
- a forward indexing head having a plurality of openings corresponding to the tube bundle to be cleaned and adapted to be removably mounted to said index.

8. The apparatus according to claim 3, wherein said means for rotating said spool comprises:
- a spool drive gear mounted on said spool drive shaft;
- a hydraulic motor having an output shaft and a drive gear mounted thereon; and
- means for coupling the output of said hydraulic motor to said spool drive gear.

9. The apparatus according to claim 8, wherein said coupling includes an endless drive chain connecting said motor drive gear and said spool drive gear.

10. A multi-lance cleaning apparatus for cleaning the interior of heat exchanger tubes comprising:
- a spool housing;

a spool rotatably mounted within said spool housing;

means for rotating said spool;

a plurality of tubular flexible lances, each said flexible lance being adapted to fit within a heat exchanger tube, each said flexible lance wrapping on said spool and having a first end in communication with a fluid source and a second end adapted to enter a heat exchanger tube;

means for supplying high pressure fluid to said flexible lances;

means for supporting and positioning said spool substantially adjacent the open ends of the heat exchanger tubes;

means for supporting and guiding said flexible lances in substantial alignment with the heat exchanger tubes to be cleaned; and a plurality of jetting tips, one said jetting tip connected to said second end of each said flexible lance, each said jetting tip having a plurality of nozzles through which the high pressure fluid exits, the high pressure fluid exiting said jetting tip causes said flexible lance to be in tension and to advance said flexible lance along the interior of the heat exchanger tube as said spool is rotated to reel out said flexible lances.

11. A multi-lance cleaning apparatus for cleaning the interior of heat exchanger tubes comprising:

a spool housing;

a spool rotatably mounted within said spool housing, said spool including a spool spindle having a rotatable high pressure swivel mounted on a first end and a drive shaft on a second end of said spindle;

means for rotating said spool;

a plurality of tubular flexible lances, each said flexible lance being adapted to fit within a heat exchanger tube, each said flexible lance wrapping on said spool and having a first end in communication with a fluid source and a second end adapted to enter a heat exchanger tube;

said first end of said spindle having an opening forming a longitudinal passageway which terminates prior to reaching said second end of said spindle, said spindle further including a plurality of radial passageways which intersect said longitudinal passageway, said radial passageways are spaced along said longitudinal passageway, there being one said radial passageway corresponding to each said flexible lance;

means for connecting each said flexible lance to a corresponding said radial passageway; and said rotatable high pressure swivel on said spool spindle having a longitudinal bore coaxially extending from said longitudinal passageway of said spindle, said rotatable high pressure swivel being in communication with the fluid source.

means for supporting and positioning said spool substantially adjacent the open ends of the heat exchanger tubes;

means for supporting and guiding said flexible lances in substantial alignment with the heat exchanger tubes to be cleaned; and means for advancing said flexible lances into and along the interior of the heat exchanger tubes.

* * * * *

UNITED STATES PATENT AND TRADEMARK OFFICE

CERTIFICATE OF CORRECTION

PATENT NO. : 5,022,463

DATED : June 11, 1991

INVENTOR(S) : THOMAS B. BOISTURE

It is certified that error appears in the above-identified patent and that said Letters Patent is hereby corrected as shown below:

Column 5, line 6 delete "B6" and insert therefor -- 86 --.
Column 8, line 51 delete "assembly 2" and insert therefor -- assembly 28 --.
Column 12, line 18 delete "and".
Column 12, line 23 delete "." and insert therefor --;--.

Signed and Sealed this

Tenth Day of November, 1992

*Attest:*

DOUGLAS B. COMER

*Attesting Officer*

*Acting Commissioner of Patents and Trademarks*